US006224185B1

(12) United States Patent
Fassler et al.

(10) Patent No.: US 6,224,185 B1
(45) Date of Patent: May 1, 2001

(54) CLEANING FLUID FOR INKJET PRINTERS

(75) Inventors: Werner Fassler, Rochester; Charles D. DeBoer, Palmyra; John E. Mooney, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/169,325

(22) Filed: Oct. 9, 1998

(51) Int. Cl.[7] ..... B41J 2/165
(52) U.S. Cl. ..... 347/28; 347/22; 510/264
(58) Field of Search ..... 347/22, 28; 510/108, 510/405, 264; 427/384

(56) References Cited

U.S. PATENT DOCUMENTS

| | | | | |
|---|---|---|---|---|
| 4,306,245 | | 12/1981 | Kasugayama et al. . | |
| 4,675,125 | * | 6/1987 | Sturwold | 510/108 |
| 4,679,059 | | 7/1987 | Dagna . | |
| 4,746,938 | | 5/1988 | Yamamori et al. . | |
| 4,853,717 | | 8/1989 | Harmon et al. . | |
| 4,855,764 | | 8/1989 | Humbs et al. . | |
| 5,128,690 | | 7/1992 | Nozawa . | |
| 5,250,962 | | 10/1993 | Fisher et al. . | |
| 5,305,015 | | 4/1994 | Schantz et al. . | |
| 5,350,616 | | 9/1994 | Pan et al. . | |
| 5,426,458 | | 6/1995 | Wenzel et al. . | |
| 5,431,722 | | 7/1995 | Yamashita et al. . | |
| 5,714,453 | * | 2/1998 | Neumiller | 510/405 |
| 5,725,647 | | 3/1998 | Carlson et al. . | |
| 5,738,716 | | 4/1998 | Santilli et al. . | |
| 5,798,144 | * | 8/1998 | Varanasi et al. | 427/384 |
| 5,917,512 | * | 6/1999 | Weber et al. | 347/28 |
| 5,997,127 | * | 12/1999 | Fassler et al. | 347/28 |

FOREIGN PATENT DOCUMENTS

| | | |
|---|---|---|
| 0263689 | 10/1987 | (EP) . |
| 0621136 | 4/1994 | (EP) . |
| 2203994 | 11/1988 | (GB) . |

* cited by examiner

*Primary Examiner*—John Barlow
*Assistant Examiner*—M S Shah
(74) *Attorney, Agent, or Firm*—Raymond L. Owens

(57) ABSTRACT

A cleaning fluid for use with an inkjet printer having orifices for injecting ink, the surface of the orifices at the injection point being formed by a predetermined material includes a liquid for cleaning the surface of the orifices, such liquid including a di or trihydroxysilane which acts as a biocide, surfactant, and humectant.

4 Claims, 2 Drawing Sheets

CLEANING FLUID FOR INKJET PRINTERS

FIELD OF THE INVENTION

This invention relates to inkjet printing and, more particularly, to a cleaning fluid for cleaning an inkjet printing head with a hydrodynamic cleaning apparatus.

BACKGROUND OF THE INVENTION

Inkjet printing is a non-impact method for producing images by the deposition of ink droplets on a substrate (paper, transparent film, fabric, etc.) in response to digital signals. Inkjet printers have found broad applications across markets ranging from industrial labeling to short run printing to desktop document and pictorial imaging. In recent years the drop size of inkjet printers has tended to become smaller and smaller, resulting in higher resolution and higher quality prints. The smaller drop size is accompanied by smaller nozzle openings in the inkjet printhead. These smaller nozzle openings are easier to plug and more sensitive to extraneous deposits that can affect both the size and placement accuracy of the inkjet drop.

It has been recognized that there is a need to maintain the ink ejecting nozzles of an inkjet printhead, for example, by periodically cleaning the orifices when the printhead is in use, and/or by capping the printhead when the printer is out of use or is idle for extended periods of time. The capping of the printhead is intended to prevent the ink in the printhead from drying out. There is also a need to prime a printhead before use, to insure that the printhead channels are completely filled with ink and contain no contaminants or air bubbles and also periodically to maintain proper functioning of the orifices. Maintenance and/or priming stations for the printheads of various types of inkjet printers are described in, for example, U.S. Pat. Nos. 4,855,764, 4,853,717 and 4,746,938. Removal of gas from the ink reservoir of a printhead during printing is described in U.S. Pat. No. 4,679,059. In U.S. Pat. No. 4,306,245 to Kasugayama et al., a liquid jet recording device provided with a cleaning protective means for cleaning and protecting an orifice is described. The cleaning protective means is provided at a reset position lying at one end of the scanning shaft of the device.

U.S. Pat. No. 5,128,690 to Nozawa, describes an inkjet apparatus comprising an inkjet head having plural discharge openings for discharging ink. A partial cap member, which can cover at least one of the discharge openings, is connected to a pressure source that can supply sufficient pressure through the covered discharge openings to force any foreign matter into a common liquid chamber. A liquid flow is created in the common chamber to flush the foreign matter from the inkjet head.

U.S. Pat. No. 5,250,962 to Fisher et al., describes a movable priming station for use with an inkjet printer having a printhead with a linear extended array of nozzles. The movable priming station includes a support capable of moving along the extended array of nozzles and a vacuum tube having a vacuum port adjacent to one end thereof. The support is controlled so that the vacuum port does not contact the nozzle-containing surface of the printhead when the support is moved along the linear array of nozzles.

U.K. Patent Application GB2203994 to Takahashi et al., describes an applicator for applying antiwetting compositions to the nozzle bearing face of a printhead of an ink drop printer. The printhead which reciprocates across the face of a platen is moved to one end of the platen where the applicator is placed. The applicator includes an extendable pad which wipes the face of the printhead.

European Patent Application 0263689 to Funk, et al., describes a fluid applicator head in which fluid is to be ejected though a plurality of nozzle orifices by means of pressure pulses or by valve means which control the flow of fluid. The applicator head is flushed out by passing a flushing fluid through the nozzle orifices in which the applicator head is adapted to be moved from a position of applying droplets of fluid to a substrate and to a flushing position at which the nozzle orifices engage with a flushing member so that flushing fluid can flow through the nozzle orifices or conduits associated therewith.

European Patent Application 0621136 to Claflin et al., describes a wet wipe maintenance device for a full width inkjet printer. A shuttle is adapted to travel on a track through a fixed path parallel to an array of nozzle openings defined in a surface of a printhead. Mounted on the shuttle are an applicator for applying a liquid to the nozzle openings and a vacuum device for applying suction to the nozzle openings. The applicator is a wick of urethane felt through which water is supplied.

U.S. Pat. No. 4,306,245 to Kasugayama et al describes a device for cleaning discharge orifices of an inkjet recording head. When the recording head moves to a print scanning region, the recording medium liquid adhering around the discharge orifices is rubbed off by a liquid absorber fitted in a rubbing-off port adjacent to a recovery port.

U.S. Pat. No. 4,306,245 to Kasugayama et al describes an inkjet recorder including a capping mode in which a cap body is brought into contact with a nozzle of a recording head so as to hermetically seal the nozzle. In a recovery mode, the cap body and a vacuum pump communicate with each other to return the recording head to a normally operative condition.

Conventional continuous inkjet printing utilizes electrostatic charging "tunnels" that are placed close to the point where the ink drops are formed in a stream. In this manner, individual drops may be charged, and these drops may be deflected downstream by the presence of deflector plates that have a large potential difference between them. A gutter (sometimes known as a "catcher") may be used to intercept the charged drops, while the uncharged drops are free to strike the recording medium. If there is no electric field present, or if the drop break off point is sufficiently far from the electric field (even if a portion of the stream before the drop break off point is in the presence of an electric field), then charging will not occur.

Inks for high-speed inkjet drop printers must have a number of special characteristics. Typically, water-based inks have been used because of their conductivity and viscosity range. Thus, for use in a jet drop printer the ink must be electrically conductive, having a resistivity below about 5000 ohm-cm and preferably below about 500 ohm-cm. For good fluidity through small orifices, the water-based inks generally have a viscosity in the range between 1 and 15 centiposes at 25° C.

Beyond this, the inks must be stable over a long period of time, compatible with inkjet materials, free of microorganisms and functional after printing. Required functional characteristics include resistance to smearing after printing, fast drying on paper, and being waterproof when dried.

Problems to be solved with aqueous inkjet inks include the large energy needed for drying, cockling of large printed areas on paper surfaces, ink sensitivity to rubbing, the need for an anti-microbial agent and clogging of the inkjet printer orifices from dried ink an other adventitious contaminants.

The non-water component of inkjet inks generally serves as a humectant that has a boiling point higher than that of water (100° C). The ink liquid vehicle components, i.e., the water and the humectants, generally possess absorption characteristics on paper and evaporation properties allowing for the desired inkjet printing speed when the ink is to be used in an inkjet printing process.

Many inkjet ink formulations have been patented. U.S. Pat. No. 5,738,716 by Domenic Santilli, et al. issued Apr. 14, 1998 describes the preparation of inkjet inks by dispersing pigments in water.

U.S. Pat. No. 5,431,722 by Yoshiro Yamashita, et al. issued Jul. 11, 1995 discloses the use of a buffer to control the pH of inkjet ink.

U.S. Pat. No. 5,350,616 by Alfred I Pan., et al., issued Sep. 27, 1994 describe nozzle orifices with combined non-wetable and wetable surfaces.

U.S. Pat. No. 5,305,015 Christopher A. Schantz, et al., issued Apr. 19, 1994 ablate nozzle openings from a polyamide film with a laser.

U.S. Pat. No. 5,426,458 Donald E Wenzel., et al., issued Jun. 20, 1995 use poly-p-xylylene films as nozzle orifice surface coatings.

U.S. Pat. No. 5,725,647 James G Carlson., et al., issued Mar. 10, 1998 disclose pigmented inks with added humectants.

An effective cleaning solution for an inkjet print head will have to be compatible with the ink used, and the many limitations on the ink described above.

There remains a need for a simple, economical inkjet printhead cleaning solution that will consistently deliver an accurate and reproducible drop of ink to provide uniform, accurate and consistent prints.

SUMMARY OF THE INVENTION

An object of this invention is to provide a cleaning fluid for an inkjet print head that is effective and economical.

This object is achieved by a cleaning fluid for use with an inkjet printer having orifices for injecting ink, the surface of the orifices at the injection point being formed by a predetermined material, comprising a liquid for cleaning the surface of the orifices, such liquid including a di or trihydroxysilane which acts as a biocide, surfactant, and humectant.

ADVANTAGES

An advantage of this invention is that the cleaning fluid is economical to formulate.

Another advantage of this invention is that the cleaning solution is effective in removing dried ink and other adventitious contaminants from the inkjet print head.

DETAILED DESCRIPTION OF THE INVENTION

Figure 1:
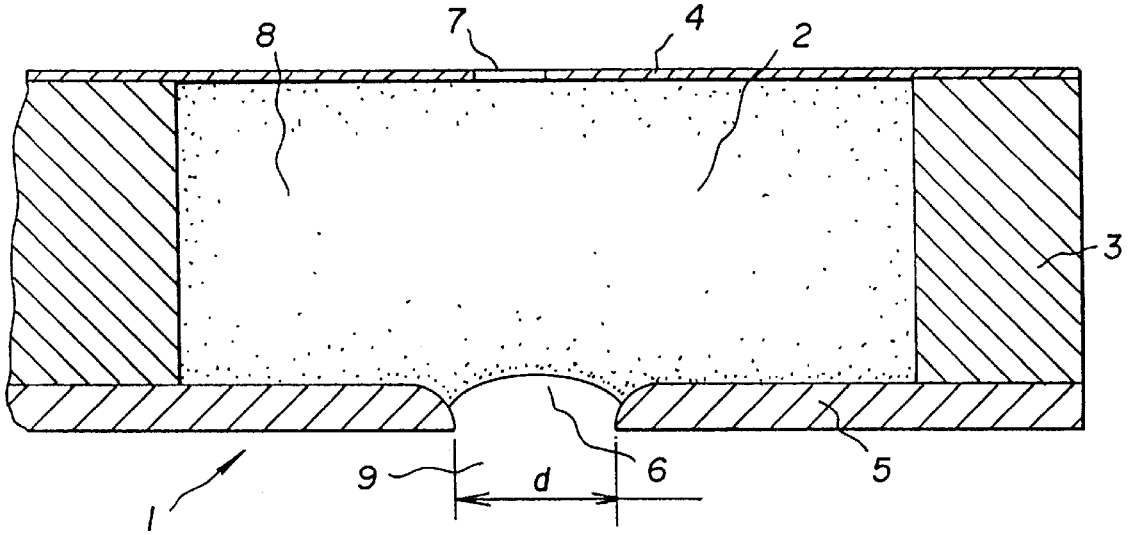
FIG. 1 is a prior art cross sectional schematic view of a typical piezo electric inkjet printhead.

FIG. 1 shows a cross-sectional view of an inkjet printhead 1. Orifice defining structures such as the depicted outlet plate 5 include orifice 9 having a diameter "d" and can be manufactured by electro-forming or sheet metal fabrication methods. It will be understood that the outlet plate 5 actually includes a plurality of orifices for forming multiple ink droplets. The outlet plate 5 is glued to the piezo walls 3. Ink 2 is included in a pumping cavity 8. An inlet orifice 7 formed in a inlet plate 4 permits ink to be delivered to the pumping cavity 8. A meniscus 6 of ink is formed in the orifice 9.

Figure 2:
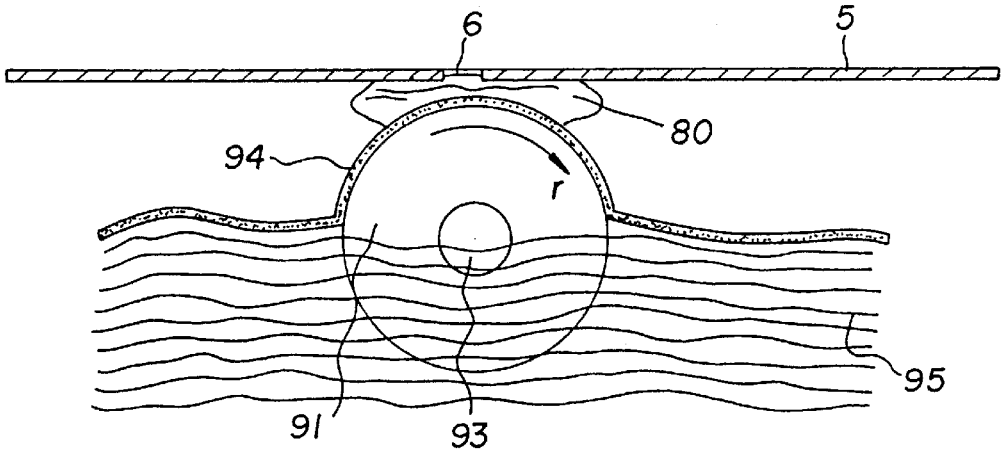
FIG. 2 shows the cleaning mechanism in accordance with the present invention.

FIG. 2 shows, mounted to a shaft 93, a rotating cleaning roller 91 partially submerged in the cleaning fluid and spaced from the structure defining the orifices 9. The spacing defines a cavity space 80. The cleaning fluid includes a liquid, and at least one tri- or di-hydroxysilane. The kinds of liquids and silanes are discussed below. The cleaning roller 91, as it rotates, carries by surface tension a coating 94 of cleaning fluid 95 to the cavity space 80 and the outlet orifice plate 5. The roller or the roller surface is made from a material that can be wetted by the cleaning fluid. Such roller surface material can be selected from the group consisting of aluminum, teflon, polyvinyl chlorine, stainless steel, glass, and titanium. The cleaning fluid will fill the cleaning cavity 80. The liquid surface friction between the stationary outlet orifice plate 5 and the rotating cleaning roller 91 will cause a great amount of turbulence and liquid shearing to remove dirt and ink from the outlet orifice plate 5 in and near the orifices 9. An arrow marked "r" indicates one of the possible two the rotational direction of the cleaning roller 91.

Figure 3:
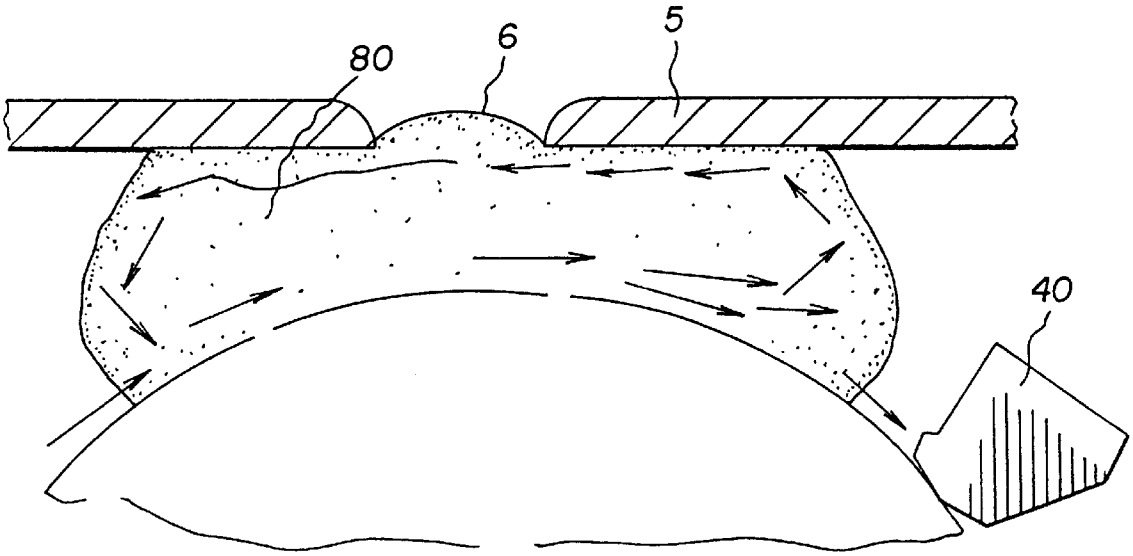
FIG. 3 shows an enlargement of the cleaning fluid coating depicting its turbulent flow in the direction opposite the rotation direction of the cleaning roller.

FIG. 3 shows in an enlarged form how the fluid friction shown by vectors 101 causes the flow of the cleaning fluid to shear dirt and other particles 40 permanently from the outlet orifice plate 5. The vectors 101 indicate the flow of fluid in the cleaning cavity 80 caused by surface friction of orifice plate 5 and cleaning roller 91.

As described in the section on the background of the invention, among the causes of inkjet clogging is growth of bacterial colonies, drying of ink particles, and failure to wet the nozzle surfaces. For these reasons, biocides, humectants, and surfactants or detergents are included in the inkjet inks. Not all biocides, humectants and surfactants are compatible with the colorants used in inkjet printing. In particular, when dispersed pigments are used as colorants, an incompatible ingredient can cause clumping and agglomeration of the pigment, resulting in either or both a) plugging of the inkjet head, and b) loss of covering power and image density of the colorant. This can limit the choice of colorants for inkjet inks, resulting in more costly inks and colorants of less than optimum hue.

In this invention, the functions of biocide, humectant and surfactant are all performed by one compound, a di or trihydroxysilane, and those functions can be accomplished in the cleaning fluid, rather than the ink. In a preferred embodiment of the invention, the cleaning fluid includes from about 5% to about 50% 3-aminopropyltrihydroxysilane in water. Other silanes which form stable solutions in water can be used, such as 3-(2-aminoethyl) aminopropyltrihydroxysilane, N-trimethoxysilylpropyl-N, N,N-trimethylammoniumchloride, trihydroxysilylpropanesulfonic acid and salts thereof, and reaction products of 3-aminopropyltrihydroxysilane and various epoxides, such as glycidol, as well as reaction products of 3-glycidoxypropyltrihydroxysilane and various amines, such as benzylamine.

Along with the principle liquid, usually water, and the silane included in the cleaning fluid, co-solvents such as N-methylpyrollidinone and butyrolactone, humectants such as ethylene glycol and sorbitol, biocides such as triclosan (Ciba Specialty Chemicals, Basel, Switzerland), viscosity builders such as polyethyleneglycol, surfactants such as Zonyl FSN (duPont Corp, Wilmington, Del.), wetting agents, leveling agents and the like can be added to provide desirable characteristics to the cleaning fluid.

The following example will illustrate the practice of this invention.

EXAMPLE 1

A smooth gold surface was provided by vacuum sputtering gold on a glass microscope slide at 100 millitorr argon pressure with a current of 40 milliamps for 3 minutes, or until the gold was opaque. This smooth surface is representative of the surface of an inkjet nozzle orifice plate. Magenta inkjet ink was dripped onto the gold surface and allowed to dry at 80° C. in a convention oven. The ink used was a mixture of 50% diethyleneglycol, 22% diethyleneglycol monobutylether, 1% urea, 0.15% surfyno1440 (a surfactant from Air Products Co.) and 10% 4-(2-hydroxy-1-naphthylazo)-1-naphthalenesulfonic acid, sodium salt, with the remainder of the mixture being water. The side was then washed with water with a hydrodynamic cleaner device. When dried with a stream of air, most of the ink was observed to have been removed, but there was a visible stain of magenta ink remaining. The slide was then cleaned with a 10% solution of 3-aminopropyltriethoxysilane in water, and the stain was gone. This example shows the superiority of the cleaning solution of this invention over plain water.

EXAMPLE 2

A rough gold surface was provided by vacuum sputtering gold on a grained anodized aluminum lithographic printing plate surface at 100 millitorr argon pressure with a current of 40 milliamps for 3 minutes, or until the gold was opaque. This rough surface is representative of the surface of a piezo inkjet pressure chamber. Magenta inkjet ink was dripped onto the gold surface and allowed to dry at 80° C. in a convention oven as described in Example 1. The side was then washed with water with a hydrodynamic cleaner device. When dried with a stream of air, most of the ink was observed to have been removed, but there was a visible stain of magenta ink remaining. The slide was then cleaned with a 10% solution of 3-aminopropyltriethoxysilane in water, and the stain was gone. This example shows the superiority of the cleaning fluid of this invention over plain water.

The invention has been described in detail, with particular reference to certain preferred embodiments thereof, but it should be understood that variations and modifications could be effected with the spirit and scope of the invention.

| PARTS LIST | |
|---|---|
| 1 | inkjet printhead |
| 2 | ink |
| 3 | piezo walls |
| 4 | inlet orifice plate |
| 5 | orifice plate |
| 6 | ink meniscus |
| 7 | inlet orifice |
| 8 | pumping cavity |
| 9 | orifice |
| 40 | particles |
| 80 | cavity space |
| 91 | cleaning roller |
| 93 | shaft |
| 94 | surface coating |
| 95 | cleaning fluid |

What is claimed is:

1. A cleaning fluid for use with an inkjet printer having orifices for injecting ink, the surface of the orifices at the injection point being formed by a predetermined material, comprising a liquid for cleaning the surface of the orifices, such liquid including a di or trihydroxysilane which acts as a biocide, surfactant, and humectant, wherein the liquid includes water and the di or trihydroxysilane includes from about 5% to about 50% 3-aminopropyltrihydroxysilane.

2. The cleaning fluid of claim 1 wherein the di or trihydroxysilane is selected from the group consisting of 3-(2-aminoethyl)aminopropyltrihydroxysilane, N-trimethoxysilylpropyl-N,N,N-trimethylammoniumchloride, trihydroxysilylpropanesulfonic acid and salts thereof, and reaction products of 3-aminopropyltrihydroxysilane and various epoxides.

3. The cleaning fluid of claim 1 wherein the reaction products of 3-aminopropyltrihydroxysilane are glycidol, as well as reaction products of 3-glycidoxypropyltrihydroxysilane and various amines, such as benzylamine or mixtures thereof.

4. The cleaning fluid of claim 1 wherein the liquid includes water and co-solvents such as N-methylpyrollidinone and butyrolactone, humectants such as ethylene glycol and sorbitol, biocides, wetting agents, and leveling agents.

* * * * *